United States Patent [19]

Van Ryn

[11] Patent Number: 4,487,135

[45] Date of Patent: Dec. 11, 1984

[54] TOOL AND IMPLEMENT CARRIER

[76] Inventor: John Van Ryn, 5525 W. 145th St., Midlothian, Ill. 60445

[21] Appl. No.: 394,458

[22] Filed: Jul. 1, 1982

[51] Int. Cl.[3] ..... A47B 35/00

[52] U.S. Cl. ..... 108/50; 108/28; 297/193

[58] Field of Search ..... 297/193, 192; 108/28, 108/50; 211/113, 71, 74; 248/146; 220/20

[56] References Cited

U.S. PATENT DOCUMENTS

| | | | |
|---|---|---|---|
| 573,703 | 12/1896 | Robbins | 108/28 |
| 1,848,331 | 3/1932 | Esslinger | 220/20 |
| 2,812,227 | 11/1957 | Hill | 297/193 X |
| 2,919,169 | 12/1959 | Jackson | 297/193 X |
| 3,751,845 | 8/1973 | Van Leeuwen | 297/193 |
| 3,887,103 | 6/1975 | Spooner | 220/20 |
| 4,019,638 | 4/1977 | Miller | 211/113 X |
| 4,106,811 | 8/1978 | Hernandez | 297/193 |
| 4,346,813 | 8/1982 | Cho et al. | 220/20 X |
| 4,436,340 | 3/1984 | Hernandez | 297/193 |

*Primary Examiner*—James T. McCall
*Attorney, Agent, or Firm*—Sabin C. Bronson

[57] ABSTRACT

Disclosed is an apparatus useful by at least one human being for holding tools and various other implements. The apparatus includes first and second holding units defining, respectively, a first space for holding tools and a second space for holding other implements; first and second supports associated with the first and second holding units, respectively; and a platform unit associated with both holding units, capable of being supported by both supports and including at least one substantially flat surface capable of supporting the weight of the human being.

10 Claims, 5 Drawing Figures

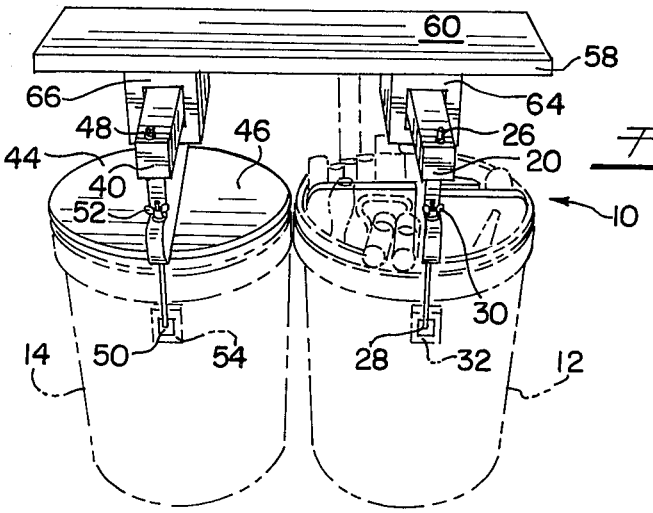
FIG. 1
FIG. 2
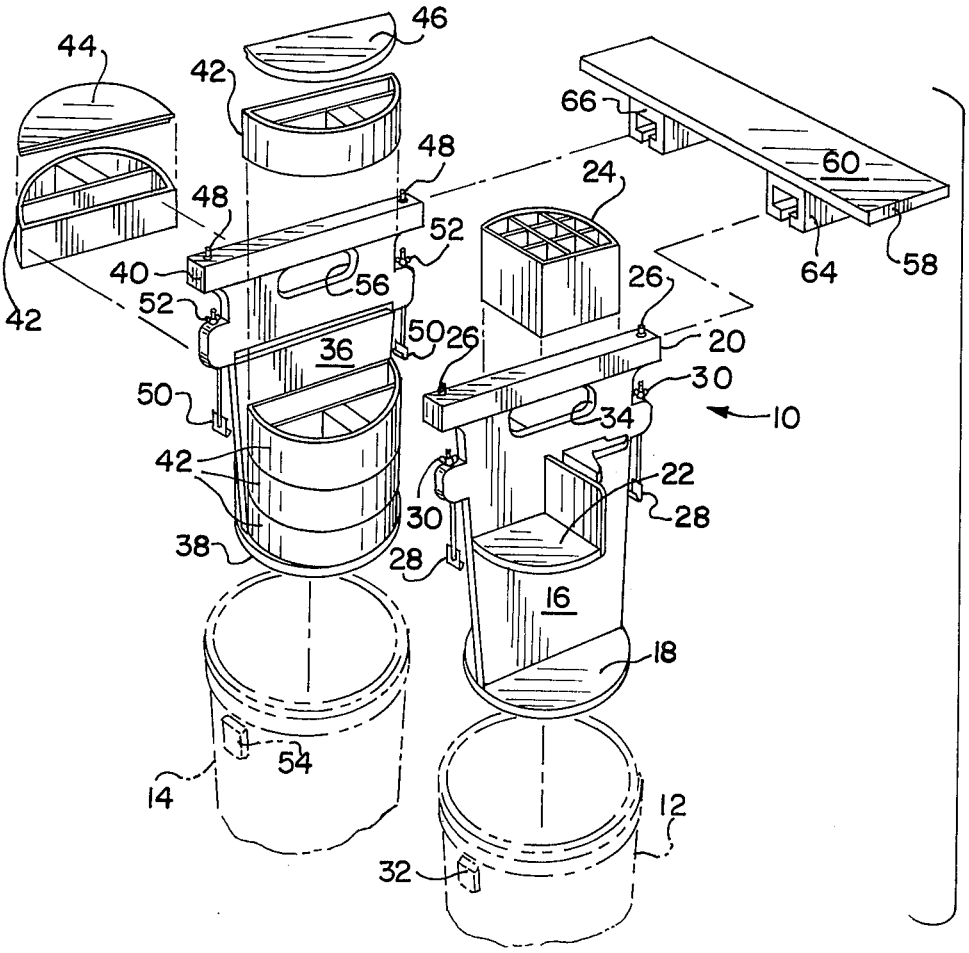

TOOL AND IMPLEMENT CARRIER

BACKGROUND AND SUMMARY OF THE INVENTION

The present invention relates to an improved apparatus for carrying tools and other implements. More particularly, this invention relates to a portable apparatus useful for carrying tools and other implements, of relatively uncomplicated construction.

Many devices for carrying tools have been suggested. See, for example, U.S. Pat. Nos. 1,373,766; 1,629,213; 2,533,355; 3,397,804; 3,823,817; 3,887,103; 3,933,243 and 4,244,469.

Although these prior art devices are effective for the most part, to carry tools, they have little or no other utility. Very often, tool boxes (tool carrying devices) are carried along by the workman during his entire day's labor and, in many cases, is his only resource available to get the job done. Clearly, it would be advantageous to, without unduly complicating the construction of the device, to increase the functionality or utility of the tool carrying device.

Accordingly, one object of the present invention is to provide an improved apparatus useful for carrying or holding tools and other implements.

Another object of the present invention is to provide a tool carrying (holding) device which is additional functionality. These and other objects of the present invention will become apparent hereinafter.

An improved apparatus useful by at least one human being for carrying (holding) tools and other implements has now been discovered. The apparatus comprises first and second holding means defining, respectively, a first space capable of holding tools and a second space capable of holding other implements, e.g., small tools, nails, screws, bolts, nuts and the like. Also included are first and second support means associated with the first and second holding means, respectively. A platform means is associated with both the first and second holding means and is capable of being supported by both the first and second support means. This platform means includes at least one substantially flat surface, capable of supporting the weight of the human being using the apparatus.

The present system is of relatively uncomplicated construction and is very effective to carry tools and other implements. In addition, the present platform means acts, in co-operation with the first and second support means, to link the preferably physically separate first and second holding means into a single working system. Further, the platform means provides substantial added utility to the present device. For example, the workman may use the substantially flat surface of the platform means to stand on so as to extend the height he is able to reach. Also, he may use it as a small work bench or as a seat on which to rest. In short, the present apparatus is effective to carry tools and other implements, is of relatively uncomplicated structure and provides for additional effectiveness and comfort of the workman using the system.

In one preferred embodiment, the present first and second support means, include first and second elongated rails, respectively. The platform means is capable of being secured, more preferably by means of first and second rail adapters included with the platform means, to, both the first and second support means so that the platform means is slideably movable along a substantial portion of the length of both first and second rails. The feature allows the platform means to be moved, as desired to, for example, allow access to the tools and other implements being carried in the first and second holding means. Preferably, the first and second rails both include stop means, e.g., pins located at or near the ends of the elongated rails, to restrict the slidable movement of the platform means, e.g., for safety purposes.

In another preferred embodiment, the first and second holding means includes a first and second outer liner, respectively, which acts to define at least a portion of the first and second space, respectively. For example, conventional buckets, e.g., five gallon buckets, may be used as first and second outer liners. In a further preferred embodiment, the first and second support means contact the bottom wall of the first and second outer liner, respectively, and extend upwardly in a plane substantially perpendicular to the respective end wall. This feature provides additional strength to the structure. In addition, the apparatus preferably comprises flat (and second) fastener means associated with both the first (second) support means and first (second) outer liner to hold said first (second) support means in place relative to the first (second) outer liner. Still further strength is thus provided.

BRIEF DESCRIPTION OF THE DRAWINGS

These and other aspects and advantages of the present invention are set forth in the following detailed description and claims particularly when considered in conjunction with the accompanying drawings in which like parts bear like reference numerals. In the drawings:

FIG. 1 is a front view in perspective, of one embodiment of the present apparatus.

FIG. 2 is a blown apart, front side view, in perspective, of the embodiment shown in FIG. 1.

DESCRIPTION OF THE PREFERRED EMBODIMENT

Figure 4:
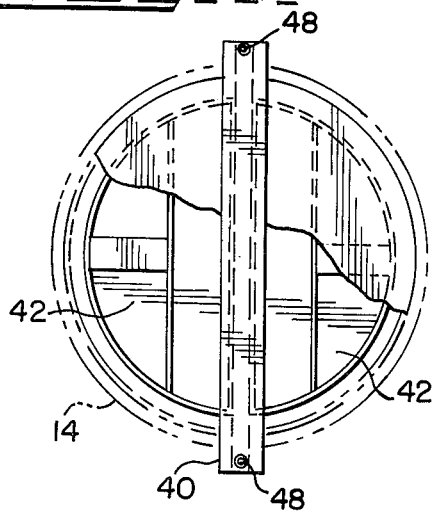
FIG. 4 is a top elevation view, partly in cross section of one portion of the embodiment shown in FIG. 1.
Figure 5:
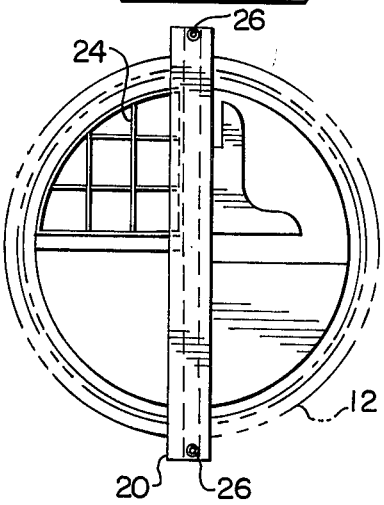
FIG. 5 is a top elevation view, partly in cross section, of another portion of the embodiment shown in FIG. 1.

Referring now to the drawings, the embodiment of the present tool carrier, shown generally at 10, includes a first bucket 12 and a second bucket 14. First insert 16, located partially inside first bucket 12, includes, at its lower end, first base 18 which contacts the bottom of first bucket 12 and, at its upper end, first elongated segment 20. A series of variously shaped projections 22 extend from first insert 16. Projections 22 are situated on first insert 16 so that first bucket 12, first insert 16 and projections 22 combine to form variously sized compartments capable of holding variously sized tools and/or other objects, such as segmented carrier 24 useful for holding variously sized drill bits and the like.

First pins 26 extend upwardly from first elongated segment 20. First hooks 28 are adjustably secured to first insert 16 by first wing nuts 30. First hooks 28 are secured to first latches 32 to aid in maintaining first insert 16 in place within first bucket 12. First insert 16 also includes first grip hole 34.

Second insert 36, located inside second bucket 14, includes, at its lower end, second base 38 which contacts the bottom of second bucket 14 and at its upper end, second elongated segment 40. A series of eight (8) segmented implement trays 42 are located within second bucket 14 are capable of storing various types and/or sizes of implements, e.g., nails, screws, nuts, bolts and the like, as desired. Second bucket 14 is covered by cover segments 44 and 46.

Second pins 48 extend upwardly from second elongated segment 40. Second hooks 50 are adjustably secured to second insert 36 by second wing nuts 52. Second hooks 50 are secured to second latches 54 to aid in maintaining second insert 36 in place within second bucket 14. Second insert 36 also includes second grip hole 56.

Figure 3:
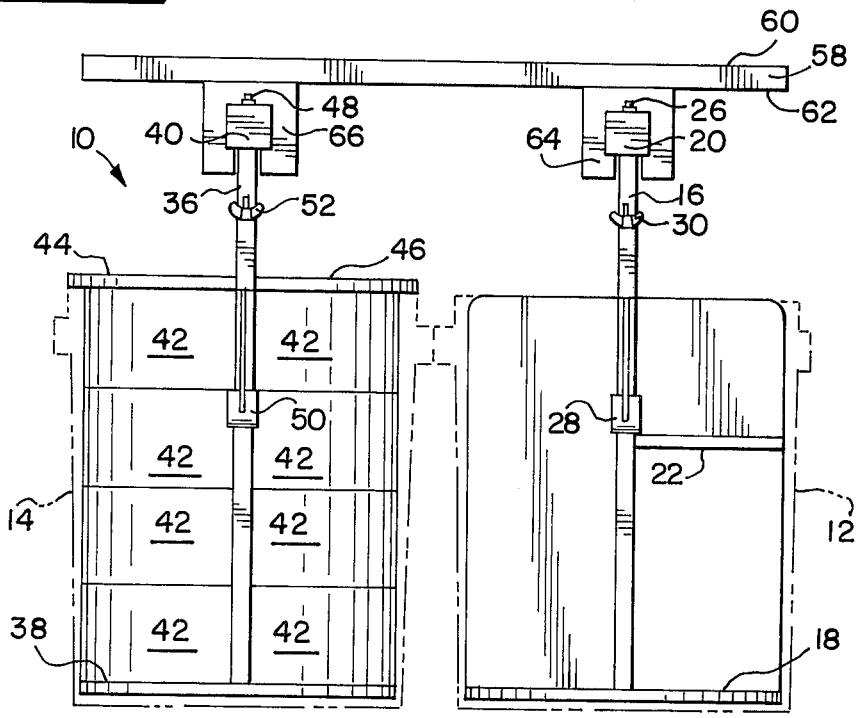
FIG. 3 is a front plan view, in cross section, of the embodiment shown in FIG. 1.

Platform member 58 includes substantially flat top surface 60 and bottom surface 62, and is structured with sufficient strength to support the weight of at least one human being. Attached to bottom surface 62 of platform member 58 are first and second sleeves 64 and 66, respectively, which surround first and second elongated segments 20 and 40, respectively, as shown best in FIGS. 1 and 3. With platform member 58 so positioned on top of elongated segments 20 and 40, top surface 60 may be used, for example, as a seat on which the workman (user of tool carrier 10) may rest, as a one step "step ladder" to allow the workman to reach higher heights, and for various other applications.

Platform member 58 is slideably movable along a portion of the length of both first and second segments 20 and 40. Thus, platform member 58 may be moved from side-to-side, as desired, to permit easy access to the tools and other implements in first and second buckets 12 and 14. This slideable movement of platform member 58 is restricted by first and second pins 26 and 48 so as to prevent first and second sleeves 64 and 66 from becoming disengaged from first and second elongated segments 20 and 40, respectively.

First and second grip holes 34 and 56 allow the workman using tool carrier 10 to move it conveniently and easily, as desired.

Tool carrier 10 functions as follows. At the beginning of work, the workman loads tool carrier 10 with tools and other implements, as desired. In order to have access to the interior of second bucket 14, cover segments 44 and 46 are removed. Once all the implements have been placed in segmented implement trays 42, cover segments are replaced on second bucket 14 so that no implements will be lost when carrying tool carrier 10 from place to place. During the loading of tools and other implements, platform member 58 may be moved along first and second elongated segments 20 and 40, as desired, to allow access to first and second buckets 12 and 14.

After the tools and other implements have been loaded, tool carrier 10 is hand carried (by first and second grip holes 34 and 56) to the work place. After selecting the tool and/or other implement to be used, the workman may step on top surface 60 of platform member 58 to perform the work. In addition, as noted above, the workman may use top surface 60 of platform member 58 as a seat, e.g., during rest periods. Top surface 60 may also be used, for example, as a small work bench, to place tools or other implements on during work, etc. When platform member 58 is used to support the weight of a person, it is preferred to position platform member 58 substantially in the middle of first and second elongated segments 20 and 40 for improved strength and safety.

After the work is complete, the tools and implements are reloaded into tool carrier 10, which is then ready to be employed in further work or stored.

While this invention has been described with respect to various specific examples and embodiments, it is to be understood that the invention is not limited thereto and that it can be variously practiced within the scope of the following claims.

What is claimed is:

1. An apparatus useful by at least one person for holding tools and other implements comprising first holding means defining a first space capable of holding said tools; first support means associated with said first holding means; second holding means, physically separate from said first holding means, defining a second space capable of holding said other implements; second support means associated with said second holding means; and platform means associated with both said first and second holding means, and capable of being supported by both said first and second support means and including at least one substantially flat surface capable of supporting the weight of said person.

2. The apparatus of claim 1 wherein said first and second support means include a first elongated rail and a second elongated rail, respectively, and said platform means is capable of being secured to both said first and second support means so that said platform means is slidably movable along a substantial portion of the length of both said first and second elongated rails.

3. The apparatus of claim 2 wherein both said first and second rails include stop means acting to restrict said slidable movement of said platform means.

4. The apparatus of claim 1 wherein said first holding means is divided into at least two differently sized subspaces to accommodate tools of varying sizes, and said second holding means is divided into at least two subspaces to accommodate different implements.

5. The apparatus of claim 2 wherein said platform means includes first and second rail adapters capable of becoming associated with said first and second rails, respectively, to secure said platform means to said first and second support means, respectively.

6. The apparatus of claim 1 wherein said second holding means includes a removable cover.

7. The apparatus of claim 1 wherein said first and second holding means includes a first and second outer liner, respectively, which acts to define at least a portion of said first and second space, respectively, said first and second outer liners each having a bottom wall.

8. The apparatus of claim 7 wherein said first and second support means contact said bottom wall of said first and second outer liner, respectively, and extend upwardly in a plane substantially perpendicular to said bottom wall of said first and second outer liner, respectively.

9. The apparatus of claim 8 further comprising first fastener means associated with both said first support means and said first outer liner to hold said first support means in place relative to said first outer liner; and said second fastener means associated with both said second support means and said second outer liner to hold said second support means in place relative to said second outer liner.

10. The apparatus of claim 1 wherein said first and second support means include first and second grip holes, respectively, useful to assist in moving said apparatus from place to place, as desired.

* * * * *